US006247945B1

(12) United States Patent
Wakui et al.

(10) Patent No.: US 6,247,945 B1
(45) Date of Patent: Jun. 19, 2001

(54) LEVER FITTING CONNECTOR

(75) Inventors: Masanori Wakui; Shunsaku Takeuchi, both of Aichi; Toshiaki Okabe; Tetsuya Yamashita, both of Shizuoka, all of (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/516,152

(22) Filed: Mar. 1, 2000

(30) Foreign Application Priority Data

Mar. 1, 1999 (JP) ..... 11-053287

(51) Int. Cl.[7] ..... H01R 13/62
(52) U.S. Cl. ..... 439/157
(58) Field of Search ..... 439/157

(56) References Cited

U.S. PATENT DOCUMENTS 6,019,620 * 2/2000 Kodama et al. ..... 439/157

* cited by examiner

*Primary Examiner*—Brian Sircus
*Assistant Examiner*—Michael C. Zarroli
(74) *Attorney, Agent, or Firm*—Sughrue, Mion, Zinn, Macpeak & Seas, PLLC

(57) ABSTRACT

A lever 22 is pivotally supported on a male connector 21 through bosses 27, and an engagement projection 30 is formed on a lower portion of a front end portion of each side wall 28 of the lever 22, and a side projection 31, which is disposed beneath the boss 27 in an initial fitting condition, is formed on each side wall 28. Guide step grooves 37 for respectively guiding the side projections 31 are formed in an inner face 32A of a hood portion 32 of the female connector 23. A first step portion 37A and a second step portion 37B are formed intermediate opposite ends of the guide step groove 37. When the side projection 31 abut respectively against the side projections 31, the engagement projections can be engaged respectively in engagement grooves 35. Therefore, the lever 22 is provisionally retained by the second step portions 37B, and in this condition the lever 22 is pivotally moved so as to positively engage the engagement projections 30 respectively in the engagement grooves 35. Therefore, the lever 22 will not idle, and the male connector 21 can be positively fitted into the hood portion 32.

5 Claims, 8 Drawing Sheets

LEVER FITTING CONNECTOR

BACKGROUND OF THE INVENTION

This invention relates to a lever fitting connector in which the connector is fitted into a mating connector by pivotally moving a lever mounted on the connector.

FIGS. 8 and 9 a related lever fitting connector. This lever fitting connector comprises a male connector 1, a lever 2 pivotally mounted on the male connector 1, and a female connector into which the male connector 1 is fitted.

The male connector 1 includes a plurality of terminal chambers 4 extending therethrough in the vertical direction, and terminals are received respectively in these terminal chambers, and are connected respectively to connection terminals in the female connector 2 when these connection terminals are inserted into the male connector from the lower side. Ribs 6 for preventing disengagement are formed respectively at one end of both side faces 5 of the male connector 1, and project laterally therefrom, the ribs 6 extending in a connector-fitting direction. Bosses 7, serving as rotation shafts, are formed respectively on the both side faces 5 of the male connector 1, and the lever 2 is pivotally supported on these bosses 7. Guide projections 5A are formed on and project laterally respectively from lower portions of the both side faces 5 of the male connector 1, and are disposed adjacent to the ribs 6, respectively. These guide projections 5A serve to hold the lever 2 in its initial condition, and are guided into the female connector 3 in the fitting direction. Blocks 5B for limiting the operating movement of the lever 2 are formed respectively on the lower portions of the both side faces 5 of the male connector 1, and are disposed adjacent to the rear end thereof, and each of the blocks 5B laterally projects an amount generally equal to the thickness of a side wall 8 of the lever 2.

The lever 2 includes the pair of right and left side walls 8, and an operating portion 9 interconnecting upper portions of the right and left side walls 8 at a rear end portion of the lever 2. The right and left side walls 8 have holes, respectively, in which the bosses 7 are fitted, respectively, and therefore the lever 2 can be pivotally moved about the bosses 7. Projected portions 8A are formed respectively at front ends of the side walls 8 remote from the operating portion 9, and these projected portions 8A are slidably received respectively in slots 6A which are formed respectively in the ribs 6 of the male connector 1, and extend in the fitting direction. An engagement projection 10 is formed on and projects laterally from each of the both side walls 8, and is disposed between the projected portion 8A and the boss 7, and these engagement projections 10 serve as a fulcrum for the pivotal movement of the lever.

The female connector 8 includes an upwardly-opened hood portion 12 into which the male connector 1 is fitted. Elongate grooves 13 for respectively receiving the ribs 6 of the male connector 1 are formed in an inner face 12A of the hood portion 12 in adjacent relation to a front end thereof, and extend in the fitting direction (in the vertical direction). Guide grooves 14 for respectively receiving the guide projections 5A, formed respectively on the both side faces 5 of the male connector 1, are formed in the inner face 12A of the hood portion 12, these guide grooves 14 extending in the fitting direction. An engagement groove 15 is continuously provided at an intermediate portion of each guide groove 14, and this engagement groove 15 is engageable with the associated engagement projection 10 of the lever 2 so as to serve as a fulcrum. A projection 16 is formed on and projects from a rear side of a lower portion of the guide groove 14, and when the lever 2 is pivotally moved in a disengagement direction, the engagement projection 10 abuts against this projection 16 so that this projection 16 can serve as a fulcrum for the disengagement operation. The plurality of connection terminals 17 project upwardly from an inner bottom face of the hood portion 12.

In this related lever fitting connector, when the male connector 1 is fitted into the hood portion 12 of the female connector 3 as shown in FIG. 9, the engagement projections 10 of the lever 2 abut respectively against the projections 16 serving as the fulcrum for when the male connector 1 is disengaged. Therefore, the male connector 1 can be inserted into the hood portion 12 of the female connector 3 without a resistance, and then the female terminals contact the male terminals, respectively. However, at this time, the operator is pivotally moving the lever 2. Therefore, there is the possibility that the operator may tend to incorrectly assume that the connectors are property fitted together when, in fact, they are not. Thus, the lever fitting connector is of such a construction that a half-fitted condition of the connector is liable to occur.

SUMMARY OF THE INVENTION

It is an object of this invention to provide a lever fitting connector in which an erroneous operation is prevented so that connectors can be completely fitted together.

In order to achieve the above object, there is provided a lever fitting connector comprising:

- a first connector housing to be fitted with a second connector housing having an engagement member;
- a lever supported by the first connector housing so as to be pivotable between a first position for disengaging the first connector housing from the second connector housing and a second position for fitting the first connector housing with the second connector housing;
- a first projection formed on the lever which is to be engaged with the engagement member when the lever is moved toward the second position to act as a fulcrum of the fitting operation while a pivot center of the lever acts as a point of action of the fitting operation;
- a second projection formed on the lever so as to situate beneath a pivot center of the lever when the lever is in the first position; and a guide step member formed on the second connector housing on which the second projection is provisionally disposed before the lever is moved toward the second position.

Accordingly, a reaction force produced when the second projection abuts against the guide step member will not act on the lever as a moment for rotating the lever since the second projection situates beneath the pivot center of the lever. In this provisional engagement condition, moving the lever toward the second direction, the first projection engages with the engagement member to establish the fulcrum. Therefore, when the lever is pivotally moved in the operating direction, the lever will not idle, and a half-fitted condition of the connector, which may occur due to misunderstanding of the operator, is prevented.

In the connector, the second projection is separated from the guide step member while the lever is moved toward the second position.

Accordingly, the second projection is not engaged with the guide step member while the lever is operated. Therefore, smooth operation for fitting or disengaging the connector housings can be attained.

Preferably, a guide groove is formed on the second connector housing for guiding the first projection when the first connector housing is engaged with the second connector housing. Here, the engagement member is continuously provided with the guide groove.

Accordingly, the first and the second connector housing are easily engaged, and thereby a stable fulcrum can be established.

Preferably, the guide groove includes a step portion with which the first projection engages to act as the fulcrum of the disengaging operation when the lever is moved toward the first position.

Accordingly, when the lever is moved toward the first direction, the pivot center of the lever becomes a point of action of the disengaging operation. Thereby the first connector housing is smoothly disengaged from the second connector housing.

Preferably, the lever includes a pair of side walls respectively supported by the first connector housing, and an operating portion for connecting the side walls, which is to be operated when the lever is moved. The operating portion includes a connection member for connecting one end portions of the side walls, and enforcement ribs protruded from both side ends of the connection member for enforcing portions where the connection member and the side walls are connected. An arcuate tapered face is formed on the respective enforcement ribs.

According to the enforcement rib, the concentration of stresses on the portions where the connection member and the side walls are connected can be relieved. Thus, the strength thereof can be increased and breakage or damage of the lever can be prevented.

Further, the lever can be easily operated since an operator's finger or the like is engaged with the tapered face. Therefore, the operability of the lever for fitting or disengaging the connector housings can be improved.

DETAILED DESCRIPTION OF THE PREFERRED EMBODIMENTS

A preferred embodiment of a lever fitting connector of the present invention will now be described in detail with reference to the drawings. FIGS. 1 to 5 show the lever fitting connector of this embodiment.

Figure 1:
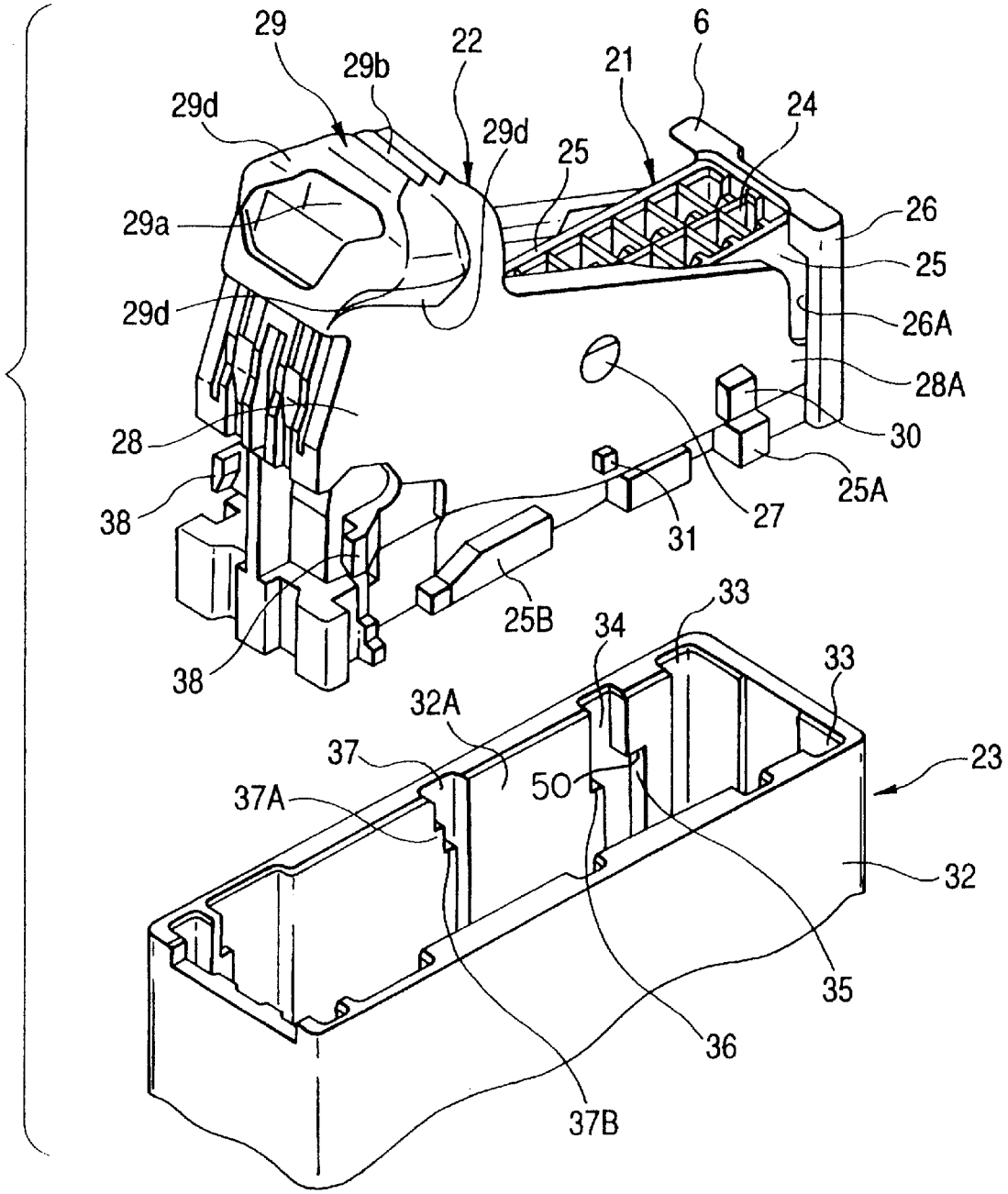
FIG. 1 is a perspective view of a lever fitting connector according to one embodiment of the present invention, showing a condition before a male connector is fitted into a female connector.
Figure 2:
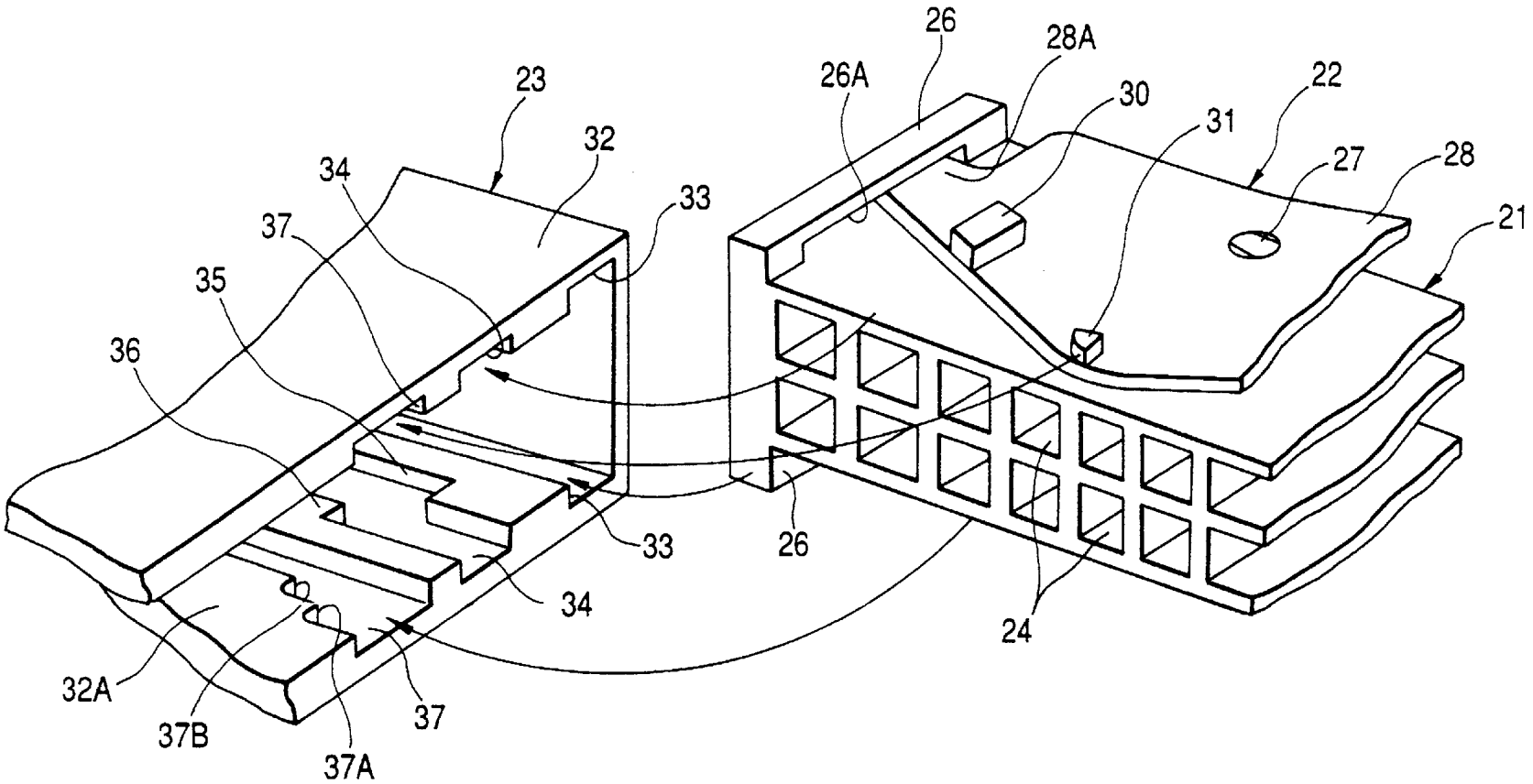
FIG. 2 is a perspective view explanatory of a fitting position of respective members of the connector shown in FIG. 1.

As shown in FIG. 1, the lever fitting connector comprises a male connector 21, a lever 22 pivotally mounted on the male connector 21, and the female connector 23 into which the male connector 21 is fitted.

The male connector 21 includes a plurality of terminal chambers 24 extending therethrough in the vertical direction, and terminals are received respectively in these terminal chambers, and are connected respectively to connection terminals in the female connector 23 when these connection terminals are inserted into the male connector from the lower side. Ribs 26 for preventing disengagement are formed respectively at one end of both side faces 25 of the male connector 21, and project laterally therefrom, the ribs 26 extending in a connector-fitting direction. Bosses 27, serving as rotation shafts, are formed respectively on the both side faces 25 of the male connector 21, and the lever 22 is pivotally supported on these bosses 27. Guide projections 25A are formed on and project laterally respectively from lower portions of the both side faces 25 of the male connector 21, and are disposed adjacent to the ribs 26, respectively. These guide projections 25A serve to hold the lever 22 in an initial condition thereof, and are guided into the female connector 23 in the fitting direction. Blocks 25B for limiting the operating movement of the lever 22 are formed respectively on the lower portions of the both side faces 25 of the male connector 21, and are disposed adjacent to the rear end thereof, and each of the blocks 25B laterally projects an amount generally equal to the thickness of a side wall of the lever 2.

Figure 3:
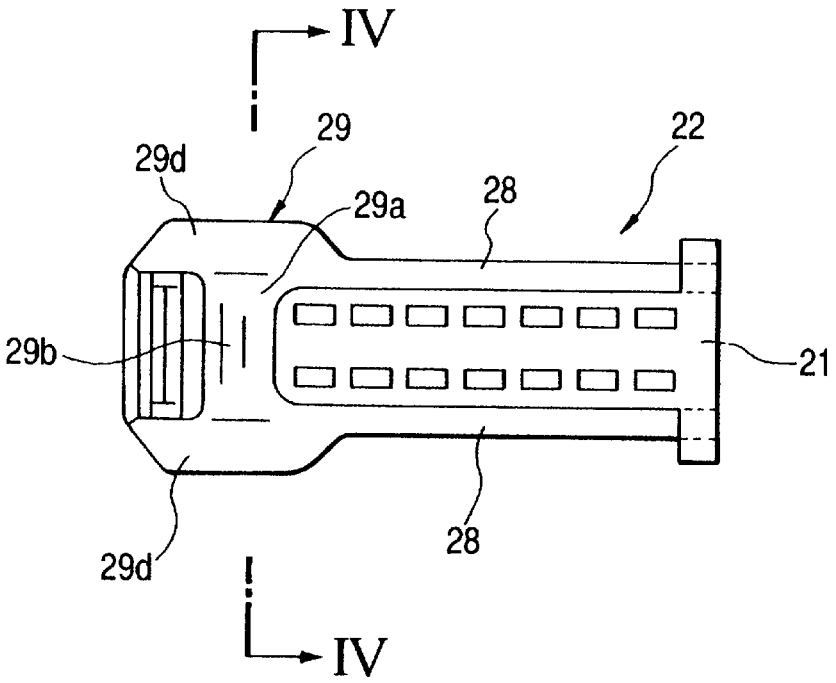
FIG. 3 shows a lever viewed from the bottom side.
Figure 4:
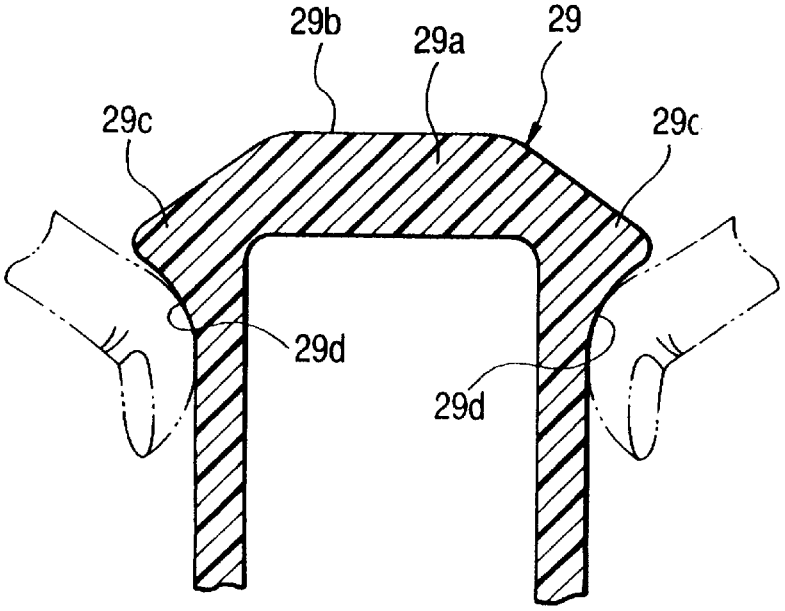
FIG. 4 is a cross-sectional view of an operating portion taken along the line IV—IV of FIG. 3.

The lever 22 includes the pair of right and left side walls 28, and an operating portion 29 interconnecting upper portions of the right and left side walls 28 at a rear end portion of the lever 22. The right and left side walls 28 have holes, respectively, in which the bosses 27 are fitted, respectively, and therefore the lever 22 can be pivotally moved about the bosses 27. As shown in FIGS. 3 and 4, the operating portion 29 includes an interconnecting portion 29*a*, interconnecting the right and left side walls 28, an operating contact face 29*b*, formed on an upper surface of the interconnecting portion 29*a*, and reinforcing ribs 29*c* formed on and projecting respectively from opposite sides of the interconnecting portion 29*a*. The operating contact face 29*b* is formed into a corrugated shape so that the finger will not slip on this contact face.

As shown in FIG. 4, the reinforcing ribs 29*c* project respectively beyond the both side walls 28, and a lower portion of each of the reinforcing ribs 29*c* is formed into a finger engagement face 29*d* of a substantially arcuate shape. The reinforcing ribs 29*c* increase the strength of those portions of the lever 22 where the both side walls 28 are continuous with the interconnecting portion 29*a,* and thus the reinforcing ribs 29*c* relieve the concentration of stresses on these continuous portions. When the lever 22 is to be pivotally moved so as to withdraw the male connector 21 from a hood portion 32, the fingers can be easily engaged with the arcuate finger engagement faces 29*d* so that the lever can be easily pulled up, thus enhancing the operability of the lever 22.

Projected portions 28A are formed respectively at front ends of the side walls 28 remote from the operating portion 29, and these projected portions 28A are slidably received respectively in slots 26A which are formed respectively in the ribs 26 of the male connector 21, and extend in the fitting direction. An engagement projection 30 (or first projection) is formed on and projects laterally from each of the both side walls 28, and is disposed between the projected portion 28A and the boss 27, and these engagement projections 30 serve as a fulcrum for the pivotal movement of the lever. In this embodiment, a side projection 31 (or second projection) is formed on a lower portion of each of the both side walls 28, and when the lever 22 is in an initial fitting condition in which the side walls 28 are abutted respectively against the guide projections 25A as shown in FIG. 1, the side projections 31 are disposed beneath the bosses 27, respectively. Resilient, elastic posture-limiting piece 38 are formed on a lower portion of the rear end of the lever 22, and extend rearwardly therefrom in a diverging manner, and these posture-limiting piece 38 serve to hold the lever 22 in the regular condition during the fitting operation.

The female connector 23 includes the upwardly-opened hood portion 32 into which the male connector 21 is fitted. Elongate grooves 33 for respectively receiving the ribs 26 of the male connector 21 are formed in an inner face 32A of the hood portion 32 in adjacent relation to a front end thereof, and extend in the fitting direction (in the vertical direction). Guide grooves 34 for respectively receiving the guide projections 25A, formed respectively on the both side faces 25 of the male connector 21, are formed in the inner face 32A of the hood portion 32, these guide grooves 34 extending in the fitting direction. An engagement groove 35 is continuously provided intermediate portion of each guide groove 34 so as to define an engagement portion 50, and this engagement groove 35 is engageable with the associated engagement projection 30 of the lever 22 so as to serve as a fulcrum. A hood-side step portion 36 is formed at a lower portion of the guide groove 34, and when the lever 22 is pivotally moved in a disengagement direction, the engagement projection 30 abuts against this hood-side step portion 36 so that this step portion 36 can serve as a fulcrum for the disengagement operation. In this embodiment, guide step grooves 37 are formed respectively in those portions of the inner face 32A of the hood portion 32 opposed respectively to the both side walls 28 of the lever 22. The side projections 31, formed respectively on the both side walls 28 of the lever 22, are guided respectively into these guide step grooves 37 in the fitting direction. The guide step groove 37 includes a first step portion 37A and a second step portion 37B. The plurality of connection terminals 40 project upwardly from an inner bottom surface of the hood portion 32.

The construction of the lever fitting connector of the first embodiment has been described above, and next the operation thereof will be described with reference to the drawings.

Figure 5:
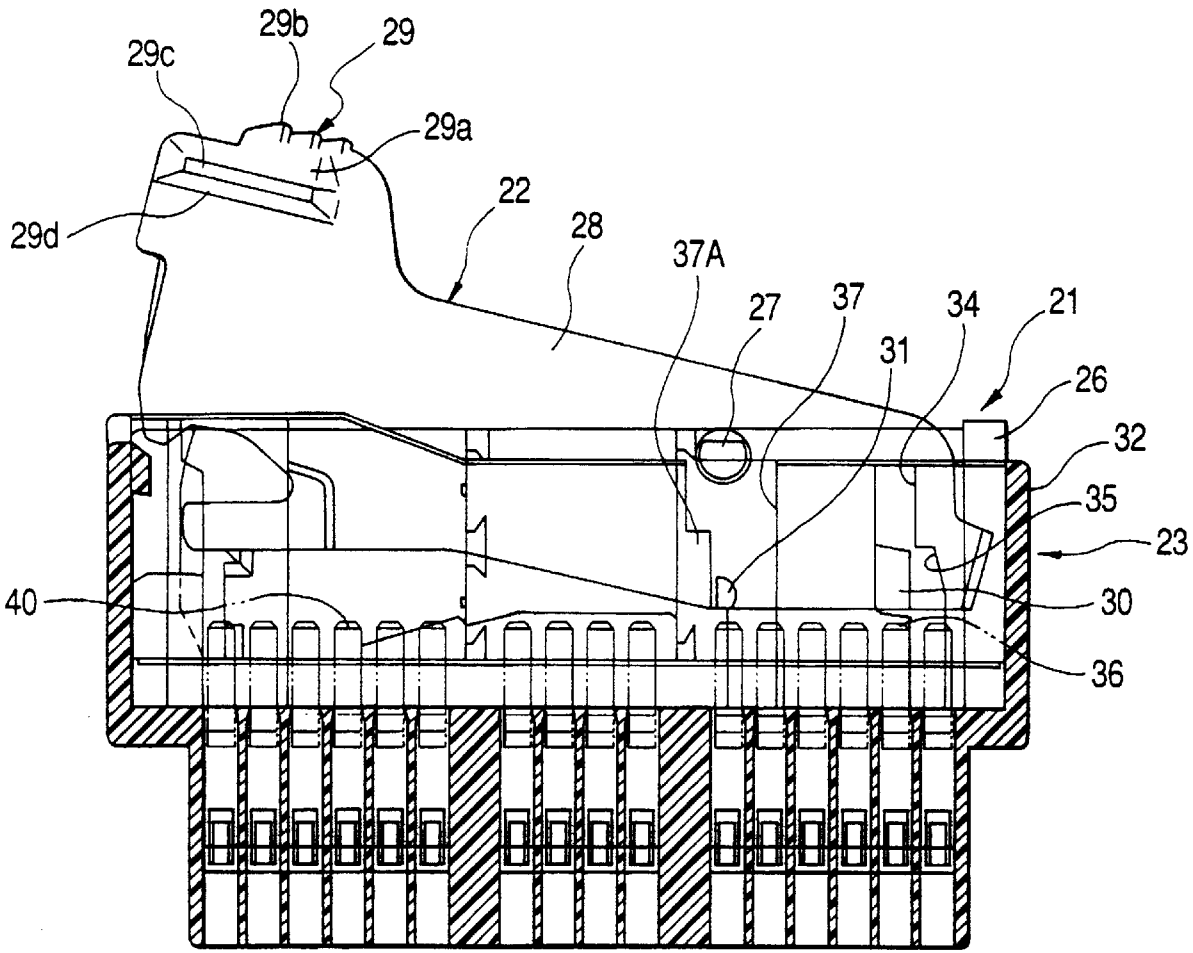
FIG. 5 is a cross-sectional view showing a half-fitted condition.

First, the male connector 21 is fitted into the hood portion 32, with the lever 22 held in the initial fitting posture (in which the lower edges of the both side walls 28 of the lever are abutted respectively against the guide projections 25A as shown in FIG. 1). As a result, the ribs 26 are inserted respectively into the elongate grooves 33 in the hood portion 32, and the guide projections 25A, as well as the engagement projections 30, are inserted respectively into the guide grooves 34, and the side projections 31 of the lever 22 are inserted respectively into the guide step grooves 37. At this time, each side projection 31 once abuts against the first step portion 37A of the associated guide step groove 37, and then rests on the second step portion 37B as shown in FIG. 5. At this time, the lever 22 will not be pivotally moved by a reaction force, produced when the side projections 31 abut respectively against the second step portions 37B, since the side projections 31 are disposed respectively beneath the bosses 27. Therefore, each engagement projection 30 is not engaged in the associated engagement groove 35.

Figure 6:
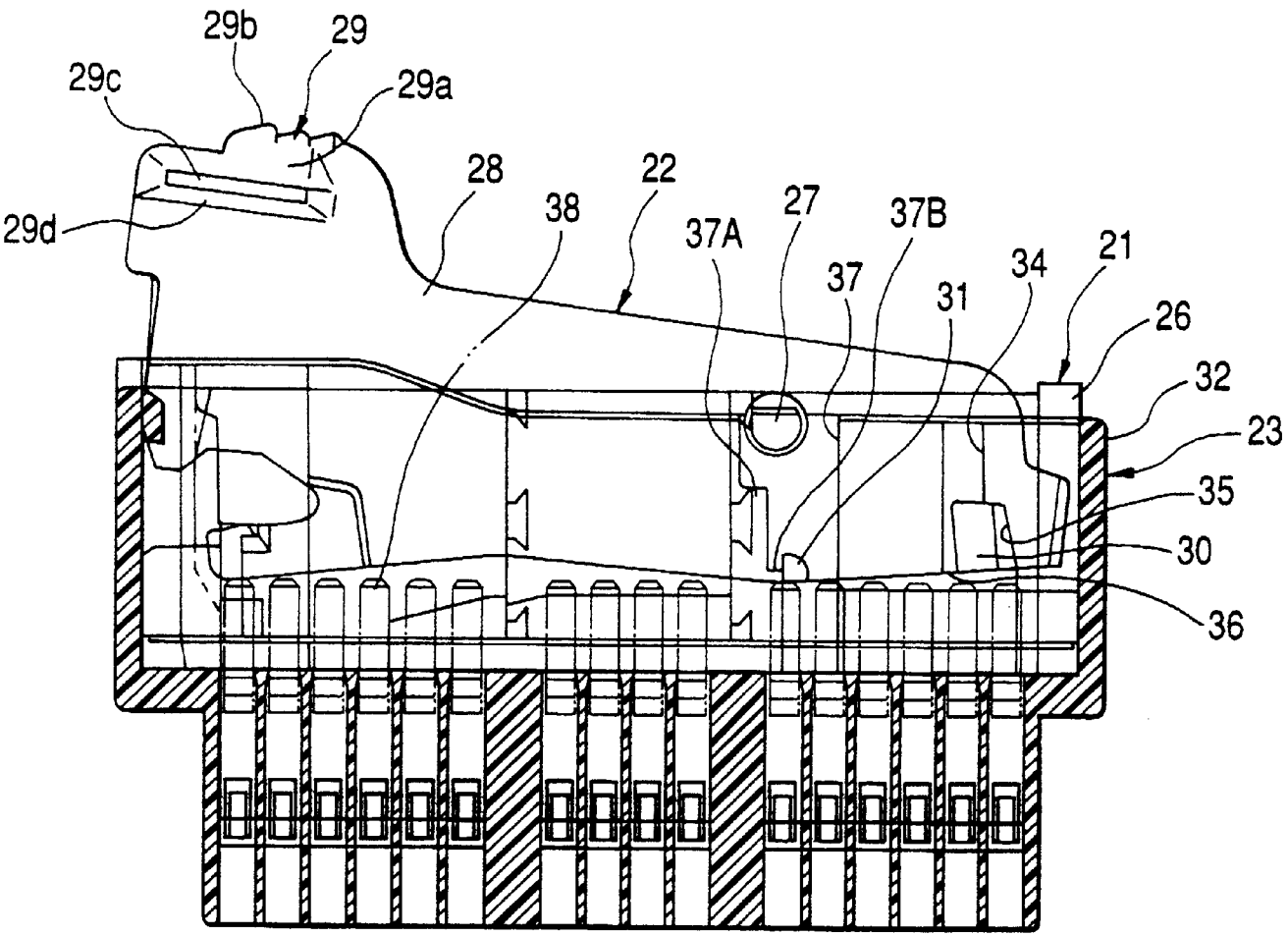
FIG. 6 is a cross-sectional view showing a half-fitted condition.
Figure 7:
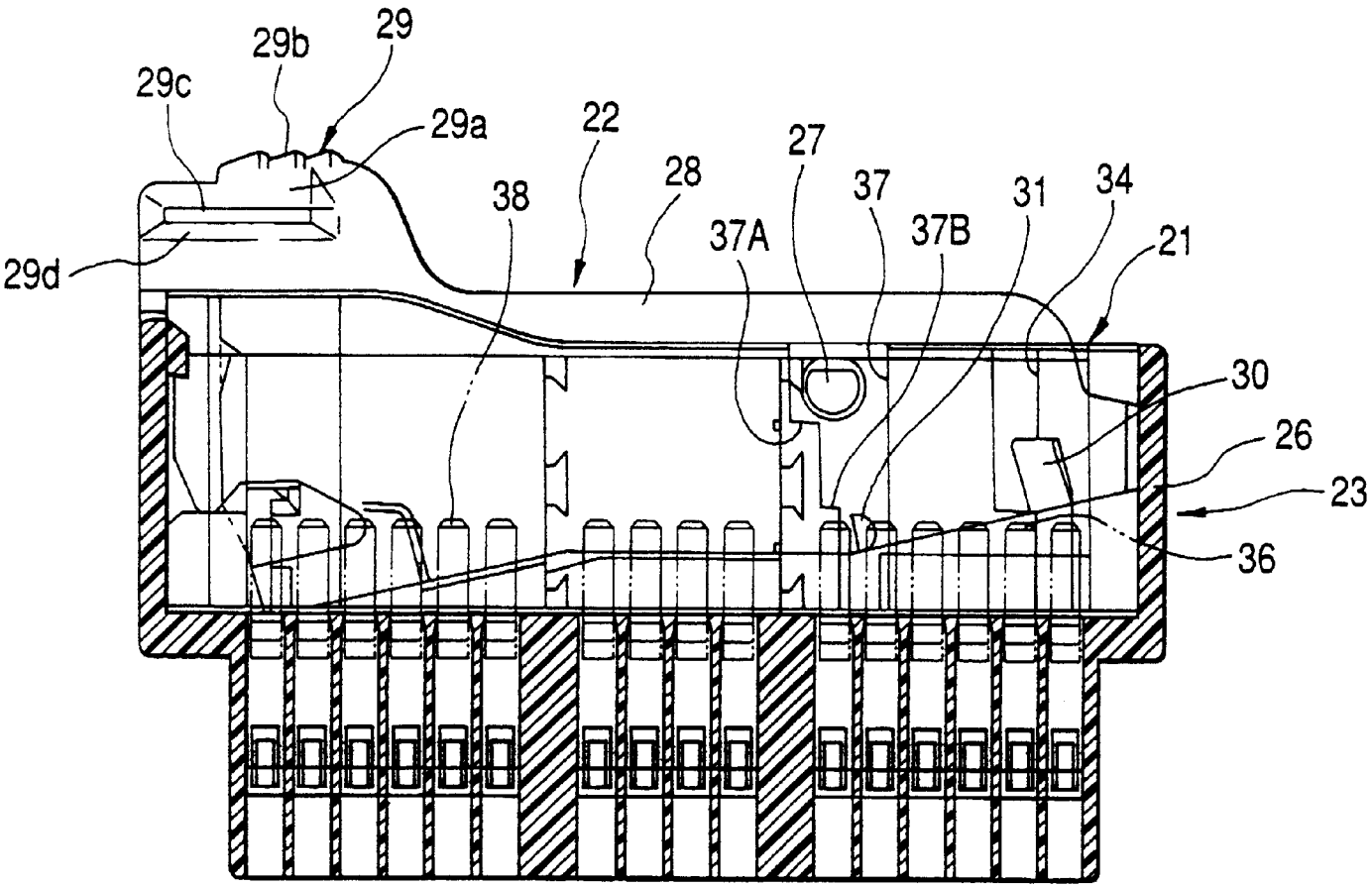
FIG. 7 is a cross-sectional view showing a completely fitted condition.
Figure 8:
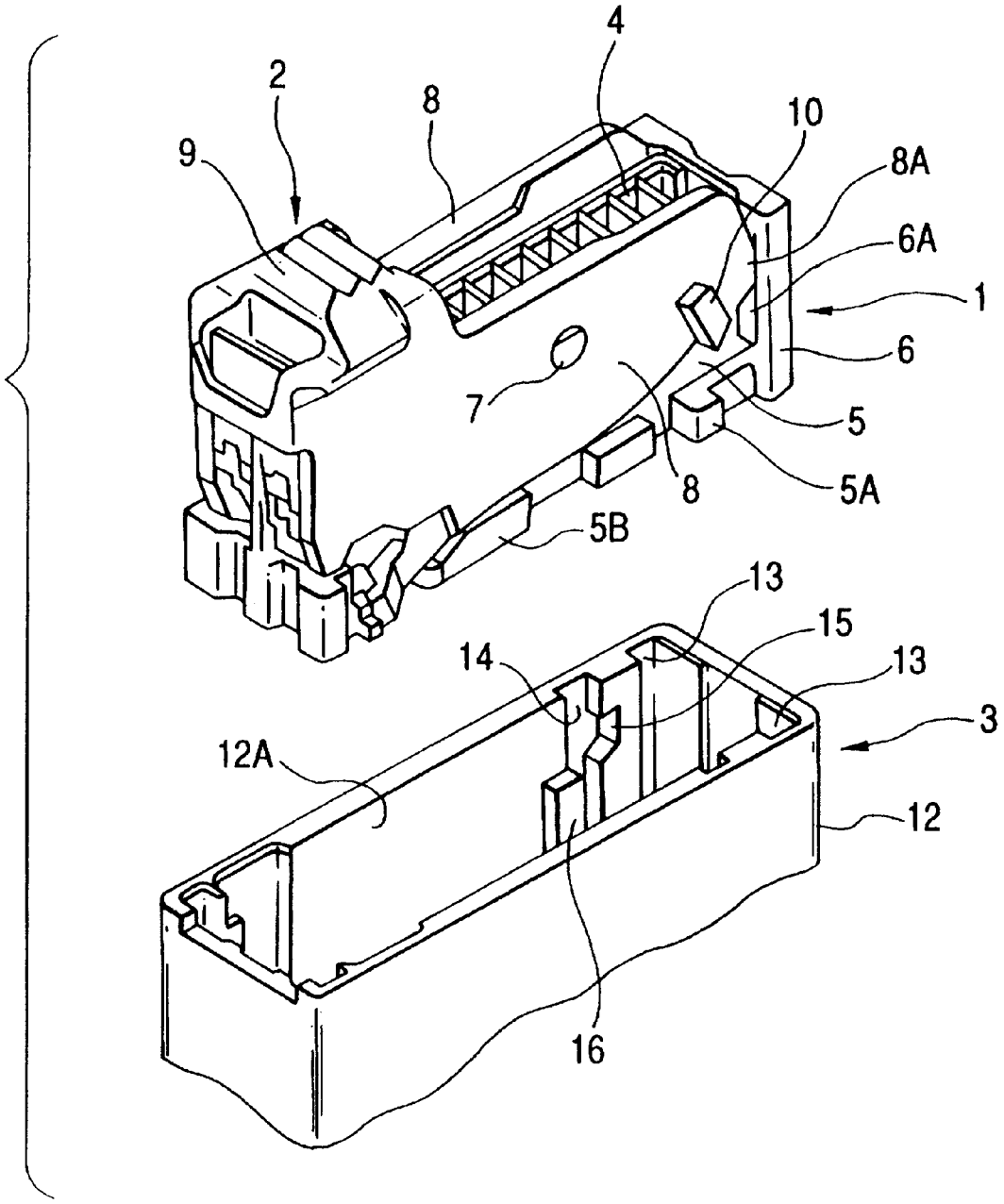
FIG. 8 (PRIOR ART)
FIG. 8 is a perspective view of a related lever fitting connector in a separated condition.
Figure 9:
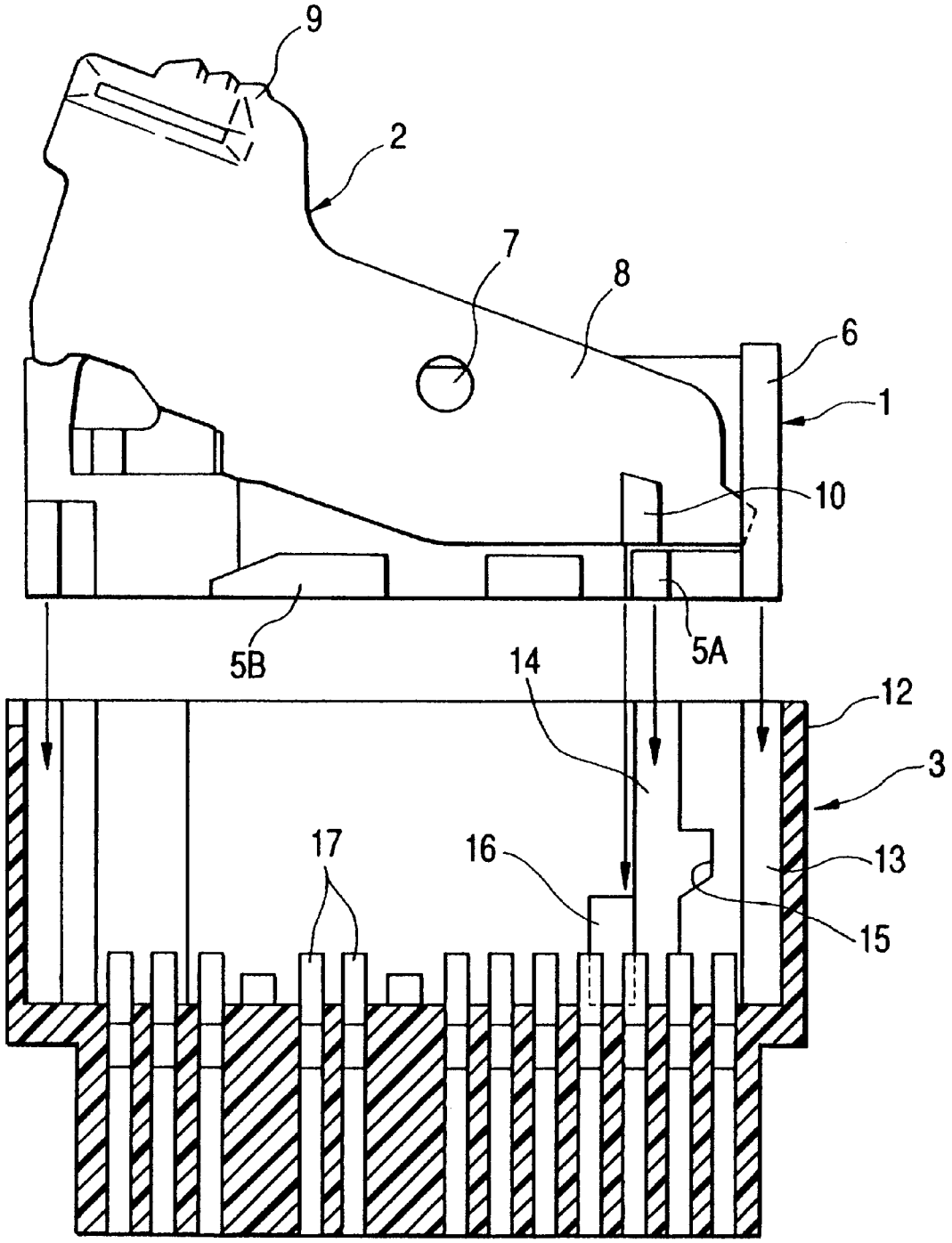
FIG. 9 (PRIOR ART)
FIG. 9 is a partly side-elevational, cross-sectional view of the related lever fitting connector before the connector is fitted.

Then, in this condition, when the operating portion 29 of the lever 22 is pressed, the lever 22 is pivotally moved, so that the engagement projections 30 are positively engaged in the engagement grooves 35, respectively. Then, in accordance with the pivotal movement of the lever 22, each side projection 31 is disengaged from the associated second step portion 37B. However, at this time, each engagement projection 30 has already been engaged in the associated engagement groove 35 so as to serve as the fulcrum for the pivotal movement of the lever 22, as shown in FIG. 6. Then, when the lever 22 is further pivotally moved, the engagement projection 30 is fitted into the engagement groove 35, and the male connector 21 is completely inserted into the hood portion 32 of the female connector 23 because of a leverage effect, so that the terminals (not shown) in the male connector 21 are completely connected respectively to the connection terminals 40 in the female connector 23 as shown in FIG. 7. In contrast, for disengaging the male connector 21 from the hood portion 32, the operating portion 29 of the lever 22 is lifted to pivotally move the lever 22, and at this time each engagement projection 30 is engaged with the associated hood-side step portion 36 so as to serve as the fulcrum, and the operating portion 29 serves as a point of application, and the bosses 27 serve as a point of action. In this manner, the force acts on the male connector 21 to raise the same, and therefore the male connector 21 can be easily disengaged from the hood portion 32. At this time, each side projection 31 is slightly spaced from the associated second step portion 37B, and therefore will not prevent the pivotal movement of the lever 22.

In this embodiment, the reinforcing ribs 29*c* are formed on the operating portion 29 of the lever 22, and therefore the concentration of stresses on the continuous portions where the both side walls 28 are continuous with the interconnecting portion 29*a*. And besides, the lower surface of each reinforcing rib 29*c* is formed into an arcuate shape, and therefore when the lever 22 is to be pivotally moved, the fingers can be easily engaged with these arcuate surfaces so that the lever 22 can easily be pivotally moved, thus enhancing the operability of the lever 22.

The present invention is not limited to the embodiment described above, and various modifications can be made within the scope of the invention. For example, in the above embodiment, although the engagement projections 30, formed on the lever 22, can be engaged respectively in the engagement grooves 35 in the inner face 32A of the hood portion 32 so as to serve as the fulcrum, the front end portions of the lever 22 may be engaged with the hood portion 32 so as to serve as the fulcrum. In this case, also, when the present invention is used, the erroneous operation, in which the operation is finished in a half-fitted condition because of the misunderstanding on the part of the operator, is prevented.

What is claimed is:

1. A lever fitting connector comprising:

a first connector housing to be fitted with a second connector housing, said second connector housing having an engagement portion;

a lever supported by the first connector housing so as to be pivotable between a first position for disengaging the first connector housing from the second connector housing and a second position for fitting the first connector housing with the second connector housing;

a first projection formed on the lever which is to be engaged with the engagement portion when the lever is moved toward the second position such that said engagement portion acts as a fulcrum of the fitting operation while a pivot center of the lever acts as a point of action of the fitting operation;

a second projection formed on the lever so as to be situated beneath a pivot center of the lever when the lever is in the first position; and a guide step member formed on the second connector housing on which the second projection is provisionally disposed before the lever is moved toward the second position.

2. The connector housing as set forth in claim 1, wherein the second projection is separated from the guide step member while the lever is moved toward the second position.

3. The connector housing as set forth in claim 1, wherein a guide groove is formed on the second connector housing for guiding the first projection when the first connector housing is engaged with the second connector housing; and wherein the engagement portion is continuously provided with the guide groove.

4. The connector housing as set forth in claim 3, wherein the guide groove includes a step portion with which the first projection engages to act as the fulcrum of the disengaging operation when the lever is moved toward the first position.

5. The connector housing as set forth in claim 1, wherein the lever includes a pair of side walls respectively supported by the first connector housing, and an operating portion for connecting the side walls, which is to be operated when the lever is moved;

wherein the operating portion includes a connection member for connecting one end portion of the side walls, and enforcement ribs protruded from both side ends of the connection member; and wherein an arcuate tapered face is formed on the respective enforcement ribs.

* * * * *